US008272843B1

(12) United States Patent
Ryznic et al.

(10) Patent No.: US 8,272,843 B1
(45) **Date of Patent: *Sep. 25, 2012**

(54) TBC WITH FIBROUS REINFORCEMENT

(75) Inventors: John E Ryznic, Palm Beach Gardens, FL (US); William A. Spanks, Jr., Palm Beach Gardens, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 1102 days.

This patent is subject to a terminal disclaimer.

(21) Appl. No.: 12/140,528

(22) Filed: Jun. 17, 2008

Related U.S. Application Data

(63) Continuation-in-part of application No. 11/337,880, filed on Jan. 21, 2006, now Pat. No. 7,404,700.

(60) Provisional application No. 60/716,577, filed on Sep. 12, 2005.

(51) Int. Cl.
*F01D 5/14* (2006.01)

(52) U.S. Cl. ..... 416/241 R; 416/241 A

(58) Field of Classification Search ..... 416/230, 416/241 R, 241 A, 241 B; 428/630, 631, 428/632

See application file for complete search history.

(56) References Cited

U.S. PATENT DOCUMENTS 7,306,828 B2 * 12/2007 Barrera et al. ..... 427/427

* cited by examiner

*Primary Examiner* — Dwayne J White
(74) *Attorney, Agent, or Firm* — John Ryznic

(57) ABSTRACT

A substrate exposed to high temperatures, the substrate having a TBC layer that includes fibers of reinforcing material to add strength to the layer of TBC. The fibers are made from carbon nanotubes to withstand the high temperatures, and have a diameter of about 0.1 mm or less in order that a thin layer of TBC can completely cover and embed the fibers within the layer. A bond coat is applied to the substrate and the fibers are attached to the bond coat to limit the fibers from being pulled away from the substrate. The carbon nanotubes also provide for improved heat transfer through the TBC to improve the cooling capability of the TBC.

19 Claims, 1 Drawing Sheet

TBC WITH FIBROUS REINFORCEMENT

CROSS-REFERENCE TO RELATED APPLICATIONS

This application claims the benefit to an earlier filed Regular patent application Ser. No. 11/337,880 filed on Jan. 21, 2006 and entitled TURBINE AIRFOIL WITH FIBROUS REINFORCED TBC; which claims the benefit to an earlier filed Provisional Application Ser. No. 60/716,577 filed on Sep. 12, 2005 and entitled TURBINE AIRFOIL WITH FIBROUS REINFORCED TBC.

FEDERAL RESEARCH STATEMENT

None.

BACKGROUND OF THE INVENTION

1. Field of the Invention

The present invention relates generally to a gas turbine engine, and in particular, to a TBC coating on a part exposed to a high temperature gas with a TBC applied.

2. Description of the Related Art Including Information Disclosed Under 37 CFR 1.97 and 1.98

In a gas turbine engine, the blade and vanes in the turbine section are exposed to the highest temperatures in the engine. Other parts of the engine are also exposed to high temperature gas flow such as the combustor liners. It is these parts which limit the operating temperature of the gas turbine engine. Higher efficiency is obtained with a higher operating temperature. However, modern materials are limited to operating temperatures below the melting temperature of the material. Air cooling of the blades has been used to allow for higher turbine temperatures without raising the melting temperature of the blades. Thermal Barrier Coatings (or, TBC) have been used on surfaces of the blade exposed to the highest temperatures to further increase the operating temperature of the turbine. TBCs are thin coatings of high temperature resistant ceramic materials that act to block the high temperatures from harming the blade material. TBCs are generally thin of about 1 mm in thickness, and are brittle. Examples of Prior Art TBCs are disclosed in U.S. Pat. No. 6,933,052 issued to Gorman et al, U.S. Pat. No. 6,890,668 issued to Bruce et al, U.S. Pat. No. 6,730,413 issued to Schaeffer et al, U.S. Pat. No. 6,686,060 issued to Bruce et al, U.S. Pat. No. 6,548,190 issued to Spitsberg et al, U.S. Pat. No. 6,485,848 issued to Wang et al, U.S. Pat. No. 6,465,090 issued to Stowell et al, and U.S. Pat. No. 6,444,335 issued to Wang et al, all of which are incorporated herein by reference.

It is desirable to make the TBC layer thicker in order to provide more protection to the airfoil surface from the high temperatures. A thicker TBC layer would allow for higher gas turbine temperatures, leading to improved efficiency of the engine. However, when the TBC layer gets too thick, pieces start to spall or chip off and eventually the underlining airfoil base material is exposed to the high gas stream temperature due to lack of TBC protection. It is therefore desirable to provide for a thicker TBC layer on an airfoil used in the high temperature regions of a gas turbine engine.

Diesel engines are one of the most efficient fuel burning engines for power production. Diesel engines burn hotter than the gasoline powered internal combustion engines and therefore are more efficient. One method of increasing the efficiency of the diesel engine is to increase the temperature of the combustion. However, the hotter combustion gas tends to burn through the top of the piston.

BRIEF SUMMARY OF THE INVENTION

It is an object of the present invention to provide for a part covered with TBC to have greater strength when it comes to spoiling.

It is another object of the present invention to provide for a TBC with a fibrous reinforcement in order to strengthen the TBC and prevent spoiling.

It is another object of the present invention to provide for a TBC with a fibrous reinforcement with higher temperature resistance of the fibers.

It is another object of the present invention to provide for a TBC with a fibrous reinforcement in which the fibers are attached to a bond coat in order to limit the fbers from being pulled away from the substrate.

It is another object of the present invention to allow for higher combustion temperatures in a diesel engine.

The present invention is directed to a part used in a gas turbine engine which requires a TBC in order to protect the part from the extreme high temperatures. The part can be a combustor liner or a transition duct or a turbine airfoil, or any part even used outside of a gas turbine engine that requires a TBC to protect the surface and the part from the extreme temperatures from the hot gas flow. The TBC layer on the part includes metal fibrous reinforcements embedded in the TBC layer to provide reinforcement such that the TBC layer can be thicker than a non-fibrous reinforced layer, and therefore allow for a higher temperature exposure for the part. The fibers are about 0.1 mm in diameter, and are made of carbon nanotubes or other materials such as from nickel, cobalt, or iron based super alloys. Carbon nanotubes can be formed from very small diameters and offer high temperature resistance as well as very good heat transfer capabilities.

DETAILED DESCRIPTION OF THE INVENTION

Figure 1:
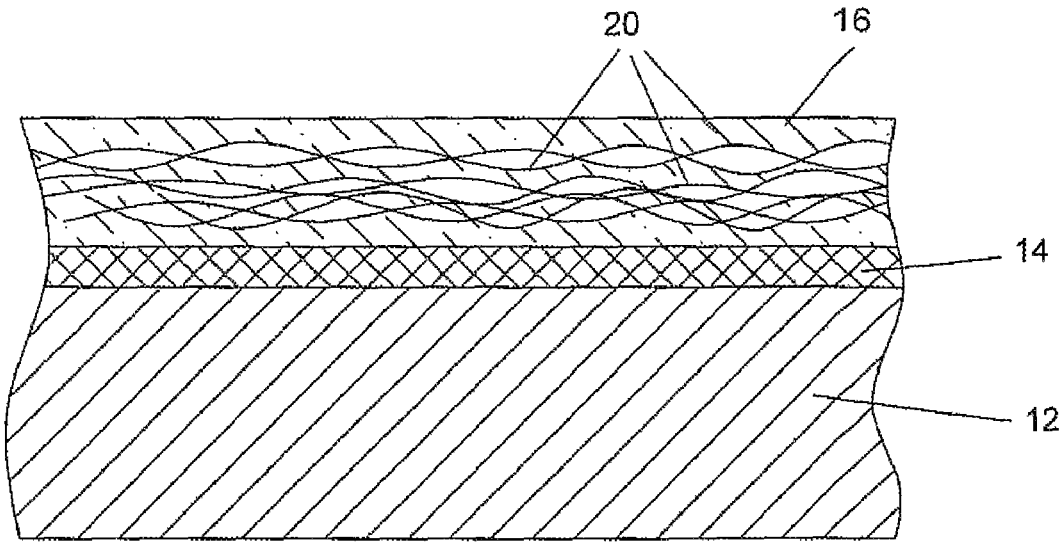
FIG. 1 shows a cross section of a portion of a TBC covered part showing the TBC applied over a bond coat onto the substrate of the blade.

The present invention provides for a method of reinforcing the TBC on the blade so that the TBC will not spall or chip off of the blade surface and therefore expose the blade surface to high temperatures above the safe operating range of the blade material. The present invention is also used for any part that requires a TBC layer for thermal protection, such as a combustor liner or the transition ducts in an industrial gas turbine engine. The fibers act to strengthen the TBC properties in tension and reduce the chance for a spalled piece to break off from the TBC layer. FIG. 1 shows the present invention, in which a blade substrate 12 includes a bond coat 14 applied onto the substrate and a TBC 16 applied over the bond coat 14. This is the standard method of using a TBC on a turbine blade or vane. The TBC is generally about 1 mm in thickness. The present invention includes a plurality of metallic fibers 20 intertwined over the surface of the bond coat 14. The metallic fibers 20 can be applied in a weave such as in fibrous laminated composite materials, or placed onto the bond coat 14 surface by wrapping a string of the fibers around the airfoil.

The TBC is then applied over the fibers 20 and allowed to harden. When hardened, the metallic fibers 20 provide a strong reinforcement to the TBC to prevent spalling of the TBC during operations.

Figure 2:
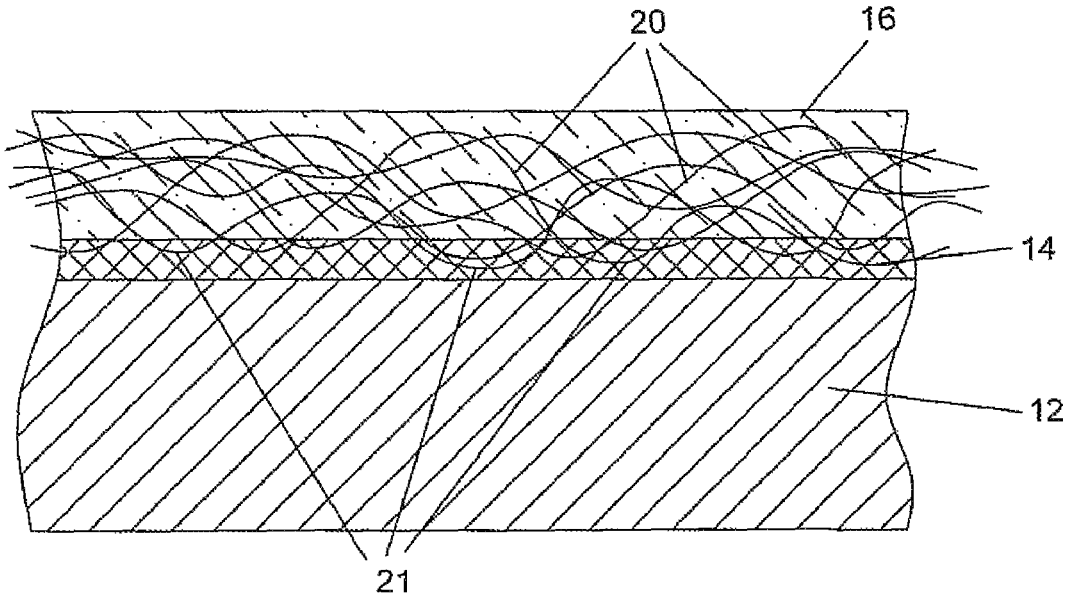
FIG. 2 shows a cross section of a portion of a TBC with the fiber reinforcement passing into the bond coating.

FIG. 2 shows the same fibrous reinforcement of the TBC but with the fibers passing into the bond coating to provide for additional strength to limit the fibers from being pulled away from the substrate. In this embodiment, the bond coat 14 can be applied using a lower temperature application process than the well known plasma method and allowed to cool down. Then the fibers are applied so that the fibers will stick into the bond coat. Then, the process of applying the TBC is performed to cover the fibers that are partially embedded within the bond coat.

A material for the fibers 20 can be the same as the TBC coated substrate or in the preferred embodiment can be carbon nanotubes. Carbon nanotubes can be made from very small tubes in order to be completely covered by the thin TBC layer. Carbon nanotubes can have a length to diameter ratio that exceeds 1,000,000 and a high tensile strength of around 64 GPa. Also, carbon nanotubes have a very high heat transfer coefficient of about 16 times higher than copper. This feature will promote heat transfer from the hot surface of the TBC to the substrate below the TBC which is cooled with a cooling fluid such as air. In a gas turbine engine airfoil with a TBC, the temperature difference between outer surface of the TBC and the substrate surface below the TBC is around 200 degrees F. depending upon the thickness.

In the case of the same material as the substrate on which the TBC is applied, a high temperature resistant material is preferred. Substrate—and, therefore fiber—materials include nickel, cobalt, or iron based super alloys. The alloys can be cast or wrought super alloys. Examples of such materials are GTD-111, GTD-222, Rene 80, Rene 41, Rene 125, Rene 77, Rene N4, Rene N5, Rene N6, $4^{th}$ generation single crystal super alloy—MX-4, Hastelloy, and cobalt, based HS-188. The fibers 20 are preferably made of one of these materials as well because of the high temperature resistance and strength. The diameter of the fibers 20 are preferably 0.1 mm or less in order to allow for the TBC thickness to remain about 1 mm. the fibers 20 can be applied over the entire blade surface and a TBC applied over the fibers, or in selected surface areas of the blade because of costs associated with applying a TBC to the blade.

The fibers in the present invention are discussed with respect to a turbine blade. However, the invention could be applied to a turbine vane as well, since vanes also make use of TBCs in order to prevent damage due to high temperatures. It is also envisioned that the fibrous coating could also be applied to a harness coating used on machine elements such as bearings and shafts. Any coating that is applied by Prior Art techniques such as thermal spraying and plasma spraying can be applied over a fiber material to add strength to the coating.

A diesel engine is more efficient than a gasoline powered internal combustion engine because the diesel engine burns hotter and is therefore more thermally efficient. The thermal efficiency of the diesel engine can be increased by increasing the combustion temperature. However, the limits to the combustion temperature have been about met because the pistons tend to burn holes in the tops when the combustion temperature is increased further. One method of allowing for higher combustion temperatures without providing cooling to the piston is to apply the carbon nanotube reinforced TBC to the top surface of the piston in the diesel engine.

The invention claimed is:

1. A substrate exposed to a high gas flow temperature, the substrate including a TBC applied on the surface, the improvement comprising:

a fibrous reinforcement embedded in the TBC layer to provide reinforcement to the layer and prevent spalling.

2. The substrate of claim 1 above, and further comprising: the fibrous reinforcement having a diameter of substantially 0.1 mm.

3. The substrate of claim 1 above, and further comprising: the fibrous reinforcement material being the same material for which the airfoil substrate is made from.

4. The substrate of claim 1 above, and further comprising: the fibrous reinforcement being made of one or more of the following materials:

GTD-111, GTD-222, Rene 80, Rene 41, Rene 125, Rene 77, Rene N4, Rene N5, Rene N6 $4^{th}$ generation single crystal supper alloy—MX-4, Hastelloy, or cobalt based HS-188.

5. The substrate of claim 1 above, and further comprising: the fibrous reinforcement includes carbon nanotubes.

6. A substrate exposed to a high gas flow temperature, the substrate including a TBC applied on the surface, the improvement comprising:

a fibrous reinforcement embedded in the TBC layer to provide reinforcement to the layer and prevent spalling;

the fibrous reinforcement includes carbon nanotubes; and, the carbon nanotubes have a diameter of less than 0.1 mm.

7. The substrate of claim 1 above, and further comprising:

a bond coat applied to the substrate; and, the fibers are attached to the bond coat.

8. The substrate of claim 7 above, and further comprising: the fibrous reinforcement includes carbon nanotubes.

9. The substrate of claim 1 above, and further comprising: the substrate is part of a turbine airfoil used in a gas turbine engine.

10. The substrate of claim 1 above, and further comprising: the substrate is part of a combustion chamber liner of a gas turbine engine.

11. The substrate of claim 1 above, and further comprising: the substrate is part of a transition duct of a gas turbine engine.

12. The substrate of claim 1 above, and further comprising: the substrate is part of a piston in a diesel engine.

13. A process of forming a TBC layer on a substrate that is exposed to a high temperature gas flow, the process comprising the steps of:

providing for a substrate;

applying a bond coat to the substrate;

placing a plurality of reinforcement fibers on the bond coat; and, applying a TBC layer over the fibers such that the fibers are completely embedded within the TBC layer.

14. The process of forming a TBC layer on an airfoil used in a gas turbine engine of claim 13, and further comprising the step of:

providing fibers that have a diameter of about 0.1 mm.

15. The process of forming a TBC layer on a substrate of claim 14, and further comprising the step of:

providing for the fibers to be formed of one or more of GTD-111, GTD-222, Rene 80, Rene 41, Rene 125, Rene 77, Rene N4, Rene N5, Rene N6 $4^{th}$ generation single crystal supper alloy—MX-4, Hastelloy, or cobalt based HS-188.

16. The process of forming a TBC layer on an airfoil used in a gas turbine engine of claim 13, and further comprising the step of: the reinforcement fibers are carbon nanotubes.

17. The process of forming a TBC layer on a substrate of claim 14, and further comprising the step of:

the reinforcement fibers are carbon nanotubes.

18. A process of forming a TBC layer on a substrate that is exposed to a high temperature gas flow, the process comprising the steps of:

providing for a substrate;

applying a bond coat to the substrate;

placing a plurality of reinforcement fibers on the bond coat; and, applying a TBC layer over the fibers such that the fibers are completely embedded within the TBC layer;

applying a bond coat to the substrate; and, securing the fibers to the bond coat prior to applying the TBC over the fibers.

19. A substrate exposed to a high gas flow temperature, the substrate comprising:

a TBC applied on the surface of the substrate;

a fibrous reinforcement embedded in the TBC layer to provide reinforcement to the layer and prevent spalling;

a bond coat applied to the substrate; and, the fibers are attached to the bond coat.

* * * * *